US005423271A

United States Patent [19]

Schulze

[11] Patent Number: 5,423,271

[45] Date of Patent: Jun. 13, 1995

[54] INCINERATION TRAYS FOR BURNING AWAY EXPLOSIVE SUBSTANCES

[75] Inventor: Walter Schulze, Holzminden, Germany

[73] Assignee: bowas-induplan chemie ges.m.b.h., Austria

[21] Appl. No.: 140,198

[22] PCT Filed: May 5, 1992

[86] PCT No.: PCT/EP92/00974

§ 371 Date: Nov. 5, 1993

§ 102(e) Date: Nov. 5, 1993

[87] PCT Pub. No.: WO92/20970

PCT Pub. Date: Nov. 26, 1992

[30] Foreign Application Priority Data

May 10, 1991 [DE] Germany ..... 41 15 233.6

[51] Int. Cl.[6] ..... F23G 7/00

[52] U.S. Cl. ..... 110/237; 588/202; 432/241

[58] Field of Search ..... 110/237, 257, 255, 235; 432/241; 588/202

[56] References Cited

U.S. PATENT DOCUMENTS 1,386,012 8/1921 Meehan .
1,474,607 11/1923 Rawley .
1,893,123 1/1933 Beth .
2,550,147 4/1951 Hardesty .
4,836,777 6/1989 Elliott ..... 432/241
4,944,236 7/1990 Sheen ..... 110/257

FOREIGN PATENT DOCUMENTS 0349865 1/1990 European Pat. Off. .
505035 4/1920 France .
2220702 11/1983 Germany .
3822648 1/1990 Germany .

*Primary Examiner*—Denise L. Gromada
*Attorney, Agent, or Firm*—Bell, Seltzer, Park & Gibson

[57] ABSTRACT

A carrier is provided as a part of a conveyor in an installation for burning away or deflagration of explosives. The carrier includes a base plate and a vat of scale and temperature-proof or resistant material mounted on the base plate for containing the explosives. The installation for the deflagration includes a deflagration reactor through which the carriers passes one after another in assembly-line operation through an entry zone and an exit zone. The invention is characterized in that the vat is mounted in spaced relation from the base plate by pillar-like supports which are distributed symmetrically on the area of the vat bottom; and in that a vertically upright bulkhead wall is arranged at least at one face of the base plate. The width and height dimensions of the bulkhead wall are such that they close the entry zone and the exit in substantially air tight manner toward the outside.

8 Claims, 4 Drawing Sheets

INCINERATION TRAYS FOR BURNING AWAY EXPLOSIVE SUBSTANCES

The instant invention relates to a carrier means for use in the deflagration of explosives, comprising a base plate and a vat of scale- and temperature-proof material mounted on the same to take up the explosives.

The term "explosives" hereinafter is to comprise both the explodable substances which include the explosives according to the accepted definition as well as the substances which are liable to explode. With respect to the instant invention the latter are solid or liquid substances which are caused to a certain extent to undergo a chemical reaction with which either high-tension gases are formed in such a short time that a sudden pressure effect is generated (explosion) or an effect occurs which is deemed equivalent to an explosion when they are subjected to certain testing methods, by heating up without a complete solid confinement or by not unusual stressing due to impact or friction without additional heating. Apart from the explosives, the explodable substances also comprise substances not made specifically for detonating or shooting, e.g. organic peroxides as catalysts, gas release agents of present day foam and plastics engineering, some pesticides, and many others. Likewise included, for instance, is the well known mixture "thermite" which is understood as being mixtures of aluminum and iron oxide which react while developing a large amount of heat, forming aluminum oxide and iron. This development of heat is utilized for example for welding rails.

By definition, explosives on the other hand are solid, liquid, or gelatinous substances and mixtures of substances produced for purposes of detonating or propelling. They are among others characterized by their metastable state, i.e. they are capable of undergoing a quick chemical reaction of decomposition without the intervention of further reactants, especially without atmospheric oxygen. Reference is also made, for example, to Rudolf Meyer "Explosivstoffe", 6th edition, page 127 et seqq. as regards the various groups of substances to be understood by "explosives" with respect to the instant invention.

Due to the fact that oxygen is not required for the decomposition reaction of the explosives, the instant case also is referred to as "deflagration" in to combustion which, as is well known, takes place only with the addition of oxygen.

The deflagration of explosives is worldwide the predominant method applied for the disposal of explosives contained, for instance, in ammunition, rockets, pyrotechnic sets, etc. especially from the military field. The term "deflagration" designates the decomposition reaction which progresses relatively slowly at a maximum of 100 m per second, as compared to the "detonation". For the sake of simplicity also the common general term "event" is used hereinafter for the terms "detonation", "deflagration", and "explosion".

Carrier means of the kind mentioned initially for use in deflagration are known in principle. The simplest and most common form of carrier means used according to the prior art are simple troughs with a kind of support which are placed more or less firmly in the open field and charged, i.e. loaded with the explosive in metered quantities, with the methods known so far from the prior art for deflagrating explosives. To produce personal safety in correspondence with the pertinent regulations for the prevention of accidents, the place where the carrier means are put for deflagration, as a general rule, is surrounded by a concrete or earth wall at least as high as a man which protects the persons involved in the deflagration from an (unintended) detonation of the explosives.

The deflagration of explosives is a rapidly developing process which is relatively unpredictable as regards its progress and hardly can be influenced upon initiation of the decomposition reaction and which, moreover, is highly exothermic, i.e. takes place with strong heat development of up to 3000° C. in the vicinity of the seat of the deflagration. Such temperature is reached in no more than seconds and is maintained throughout the whole combustion process so that the direct surroundings of the seat of the deflagration and here particularly the carrier means heat up extremely. The result for the carrier means is that it becomes greatly deformed irreversibly due to the thermal effect, it even "crumples" so that the known carrier means of the kind mentioned initially dispose of only very limited reusability.

This disadvantage is not very serious with the methods known so far for the deflagration of explosives outside because there—as already explained above—the simplest forms of carrier means are being used which are merely placed on the ground at the place of deflagration and possibly can be used several times in a row since the most unvarying shaping possible of the carrier means is not important with such installations in the open field.

However, greater environmental awareness and conditions which are getting stricter in environmental legislation, for example the 4th and 17th BImSchV, require, especially most recently, novel methods and apparatus for deflagrating explosives aimed at preventing the emission into the atmosphere of the gaseous reaction products and the aerosols contained in these exhaust gases. In contrast to the burning in the open field or in corresponding open installations, this aim requires deflagration in closed spaces, for instance in a deflagration reactor. Yet with such closed deflagration installations the short lifetime of the carrier means no longer is acceptable since they present an important part of an installation for deflagration if it is to be operated under economical aspects. Under economical aspects in this context means that a plurality of carrier means become effective successively and alternatingly by first being loaded with the explosives to be burnt up, subsequently being supplied to a deflagration reactor or, in general: a place of deflagration, and after completion of the deflagration being freed of the solid or liquid reaction products.

It is at this problem, that the instant invention starts which has for its object to develop a carrier means of the kind mentioned initially such that it will be reusable in normal scope in spite of the great heat development during the deflagration of explosives.

This object is met, in accordance with the invention, with a carrier means of the kind mentioned initially which comprises a base plate and a vat fixed on the base plate to receive the explosives to be burnt up, in that the vat is mounted spaced from the base plate by pillar-like supports which are distributed symmetrically over the surface of the vat bottom.

The advantages of the solution according to the invention, on the one hand, reside especially in the fact that the vat, for being mounted spaced from the base plate, is surrounded at the outside by cooling air, whereby the enormous heat-up of the vat body is reduced to a remarkable degree. On the other hand, the fastening according to the invention of the vat body on the base plate has proved to be extremely successful in corresponding tests with a view to the stabilization and configurational stability of the vat body. To an extremely reduced extent does the vat body tend to deform, as explained, and especially it substantially readopts its general shape upon termination of the deflagration due to a distribution of the pillar-like supports throughout the surface of the vat bottom. The result is a carrier means predominantly of stable shape with nothing in the way of its frequent reusability although it is exposed again and again to the enormous development of heat. Thanks to the kind of fastening of the vat on the base plate as well as to the spaced arrangement of the vat from the base plate, therefore, on the one hand, the forces generated during deflagration by the thermal stressing of the vat body material are dissipated through the pillar-like supports acting as spacers and, at the same time, the high temperatures developed during deflagration remain restricted to the vats substantially due to the fact that the space between the vat body and the base plate created by the spacers acts as a temperature reducing space.

Preferred further developments of the invention are indicated in the subclaims.

For instance, it is the result of tests that an arrangement of the pillar-like supports in a symmetric pattern of five shows particularly good stability success.

Preferably it is provided for further stabilization of the vat that the vat is designed at its upper edge so as to circumferentially angularly jut out. The revolving edge thus formed, for being directed outwardly, is not seized by the hot exhaust gas flow resulting from the deflagration of the explosives, directed upwardly, and consequently remains at a relatively cooler temperature which contributes to the configurational stability of the vat during deflagration and afterwards.

Another advantageous further development relates especially to the case where a plurality of carrier means are conveyed one after the other, as if in assembly line operation, to a place of deflagration, there the explosives are ignited, and the carrier means are transported on from that place. To this end it is advantageously provided that each carrier means has a bulkhead wall at least at one of the face ends of the base plate which bulkhead wall is fastened vertically upright on the base plate and, in its width and height dimensions, exceeds those of the vat. These bulkhead walls at first fulfill two essential functions: on the one hand, spark-over to subsequent carrier means (which still are loaded with explosives) is to be prevented during the deflagration of the explosives on one carrier means; on the other hand, the high- temperature thermal radiation occurring during deflagration is to be deflected upwardly to thereby also prevent the thermal radiation from spreading to the subsequent carrier means which still carry explosives.

It is preferably provided for a carrier means as part of a conveyor means in an installation for the deflagration of explosives, comprising a deflagration reactor which is passed successively by the carrier means in assembly-line operation through an entry zone and through an exit zone, that the bulkhead walls of the carrier means are dimensioned such that they close the entry zone and the exit zone in substantially airtight manner towards the outside. This further development of the carrier means is especially advantageous for the reason that a defined air current must constantly flow through a deflagration reactor in the direction of transportation of the carrier means, which air flow fulfills several important tasks: on the one hand, it guarantees the quantitative conveyance of the gaseous reaction products and the aerosols contained in them into a scrubbing means connected downstream of the deflagration reactor. Furthermore, the air flow is to limit the inlet temperature of the exhaust gases at the devices belonging to the downstream scrubbing means and, on the whole, the air temperature in the deflagration reactor to a maximum value of, for example, approximately 300° C. in order to protect the downstream equipment and further reduce the probability of an explosion of the explosives. Furthermore, the air flow serves to move away the sparks splashing up during deflagration, and finally oxidizing conditions are adjusted in the deflagration reactor due to the oxygen content of the air flow, and they promote the residual combustion of the substances not oxidized during deflagration. For safeguarding the defined air flow described through the deflagration reactor, it is advantageous that the bulkhead walls of the carrier means shut off the entry and exit zones toward the outside in almost complete air-tight fashion, i.e. except for a negligible degree.

Advantageously, the bulkhead walls of the carrier means are also given a cleaning function within the deflagration reactor the deflagration reactor. Furthermore, the air flow is to limit the inlet temperature of the exhaust gases at the devices belonging to the downstream scrubbing means and, on the whole, the air temperature in the deflagration reactor to a maximum value of, for example, approximately 300° C. in order to protect the downstream equipment and further reduce the probability of an explosion of the explosives. Furthermore, the air flow serves to move away the sparks splashing up during deflagration, and finally oxidizing conditions are adjusted in the deflagration reactor by the oxygen content of the air flow, and they promote the residual combustion of the substances not oxidized during deflagration.

Preferred further developments of the invention are indicated in the subclaims.

For instance, it is a result of tests that an arrangement of the pillar-like supports in a symmetric pattern of five shows particularly good stability success.

Preferably it is provided for further stabilization of the vat that the vat is designed at its upper edge so as to circumferentially angularly jut out. The revolving edge thus formed, for being directed outwardly, is not seized by the upwardly directed, hot exhaust gas flow resulting from the deflagration of the explosives, and consequently remains at a relatively cooler temperature which contributes to the configurational stability of the vat during deflagration and afterwards.

Advantageously, the bulkhead walls of the carrier means are also given a cleaning function within the deflagration reactor whose inner walls preferably are lined with temperature-proof fibrous material, by having selected the width of the bulkhead walls such that whose inner walls preferably are lined with temperature-proof fibrous material, by having selected the width of the bulkhead walls such that the side edges of these bulkhead walls glide along the fibrous material. Especially at the sidewalls of the deflagration zone inside the deflagration reactor, a series of solid reaction products deposit which are "scraped off", according to an advantageous further development, by the bulkhead walls when the latter move past them on the conveying track.

In the above context it is further preferably provided that the width of the bulkhead walls falls short of that of the base plate by a defined amount, and that the base plate extends laterally under the lining of fibrous material at the inner walls of the deflagration reactor. Hereby it is achieved that the residues scraped off the lining of the inner walls do not remain in the deflagration reactor but instead fall on the base plate and are carried out of the deflagration reactor together with the carrier means.

A preferable further development of the invention according to which the base plate is designed as an undercarriage with wheels and according to which an upper coupling plate and a lower coupling plate are fastened at one face end of the base plate, which coupling plates have the width of the bulkhead wall and project in longitudinal direction over the base plate to such an extent that they receive between them, at least in its marginal area, the base plate of an adjacent carrier means which is coupled on, serves for use of the carrier means within an installation for deflagration. The coupling area thus designed of the movable carrier means has a number of advantageous functions: on the one hand, the thrust forces from one carrier means to the adjacent carrier means are transmitted through the respective base plates. Due to the fact that the width of the upper and lower coupling plates corresponds to the width of the bulkhead wall and further due to the fact that both coupling plates of a carrier means extend over and under, respectively, the base plate of the adjacent carrier means which is coupled on, it is achieved that the carrier means lined up form a continuous compartmentalization in the deflagration reactor against the floor, whereby the track of the carrier means is protected from reaction products falling down. Moreover, the upper coupling plate has the effect that no explosive which might be caused to detonate by the coupling pressure is located at the contiguous face ends of the base plates of adjacent carrier means. Furthermore, it is of great advantage for the undisturbed operation of the installation mentioned for the deflagration of explosives that, because of the special structure of the coupling area, one carrier means will carry the adjacent carrier means in case of a broken axle or any other damage to the undercarriage so that the damaged carrier means is moved out of the deflagration reactor and then can be exchanged without interfering with the continuously progressing disposal operation. Finally, it is of advantage with the continuous compartmentalization against the bottom formed by the base plates which are contiguous at their face ends, that an intentional air flow under the base plates of the carrier means takes care of the cooling of the base plates and of additional cleaning of the track. Finally, it is of great advantage in practice that the coupling area designed according to the invention of the carrier means can be cleaned without any problem, which is necessary for reasons of safety before its renewed use.

As an alternative or in addition to the vats of the carrier means, these can comprise devices for the reception or retention of bodies which contain explosives to be burnt up. These bodies may be separated or opened parts of ammunition of the most different sizes.

A further development according to which a brush of conductive material is arranged in travelling direction in front of each wheel of the carrier means which brush is pressurized and glides on the track in front of the wheel and is connected conductively to the carrier means, serves to increase the operational safety of the carrier means. This brush essentially fulfills two advantageous functions: on the one hand, electrostatic charges between the track and the carrier means are led away through the brush and, on the other hand, the brush acts as a sweeping brush to clean the track. These advantageous further developments of the carrier means further may be enhanced by harmonizing the material of the wheels of the carrier means and the material of the track in the deflagration reactor in a favorable manner with respect to each other. An exemplary pairing of materials is plastics for the wheels and brass for the tracks.

A preferred embodiment of the invention will be described in greater detail below with reference to a drawing, in which.

Figure 1:
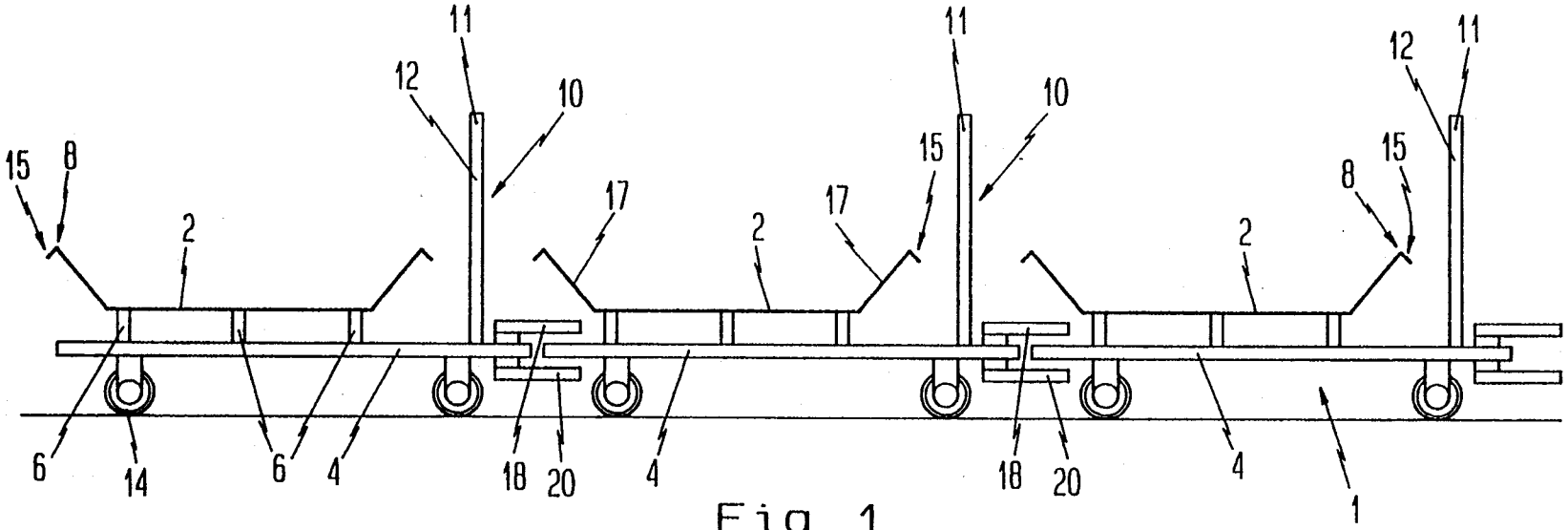
FIG. 1 is a side elevational view of a plurality of movable carrier means coupled one behind the other for use in deflagration.

FIG. 1 shows a plurality of carrier means 1 for use in deflagration which are coupled behind one another by couplings 20. The carrier means 1 essentially consist of a base plate 4 and a vat of scale- and temperature-proof material, for example steel, mounted on the base plate 4 to receive the explosives to be burnt up. The vat 2 is mounted spaced from the base plate 4 by means of pillar-like spacers or supports 6 so that free space remains between the bottom of the vat and the base plate 4. The supports 6 are arranged in a symmetric pattern of five, whereby the forces resulting during deflagration from the thermal stressing of the material of the vat are dissipated in particularly advantageous manner and consequently deformation of the vat is counteracted.

The carrier means further include wheels 14 mounted under the base plate 4 so that the carrier means 1 can be moved through the deflagration reactor along a conveyor path by means of a corresponding drive of their own or a separate drive means.

At the front face end 10 of each carrier means 1, as seen in travelling direction, a bulkhead wall 12 is fastened in vertically upright position on the base plate 4 and destined to prevent both spark-over from the respective carrier means 1 which at this instant is loaded with deflagrating explosives to subsequent carrier means and the spreading of thermal radiation which occurs during deflagration to the subsequent carrier means 1.

An upper coupling plate 18 and a lower coupling plate 20 are fixed at each face end 10 of the base plate 4 of each carrier means 1, the width of the couplings plates corresponding to that of the bulkhead wall 12.

The upper and lower coupling plates 18, 20 project so far beyond the base plate 4 in longitudinal direction that they receive the base plate 4 of the adjacent, coupled carrier means 1 between them. The adjacent carrier means 1 shown here in FIG. 1 are not yet fully coupled; that is the case when the adjacent base plates 4 contact each other at their face ends because then the thrust forces are transmitted from one carrier means to the next. The upper coupling plate 18 prevents explosives from reaching the coupling area—especially the area of the two continguous base plates 4—which explosives might be caused to explode by the pressure of the abutting base plates 4. The lower coupling plate 20 in addition makes sure that neither explosives nor reaction products can fall down on the track 25 between the carrier means. The lower coupling plates 20 also cooperate with the mutually abutting base plates 4 and the upper coupling plates 18 to form a continuous compartmentalization against the bottom, a circumstance favoring a cooling air stream which sweeps by between the undercarriages under the carrier means 1.

The upper edge 8 of the vat 2 is designed so as to be circumferentially angularly jutting out so that a circumferential edge 15 is present which is not seized by the upwardly directed thermal radiation and imparts to the vat 2 considerable stability during the deflagration process.

Figure 2:
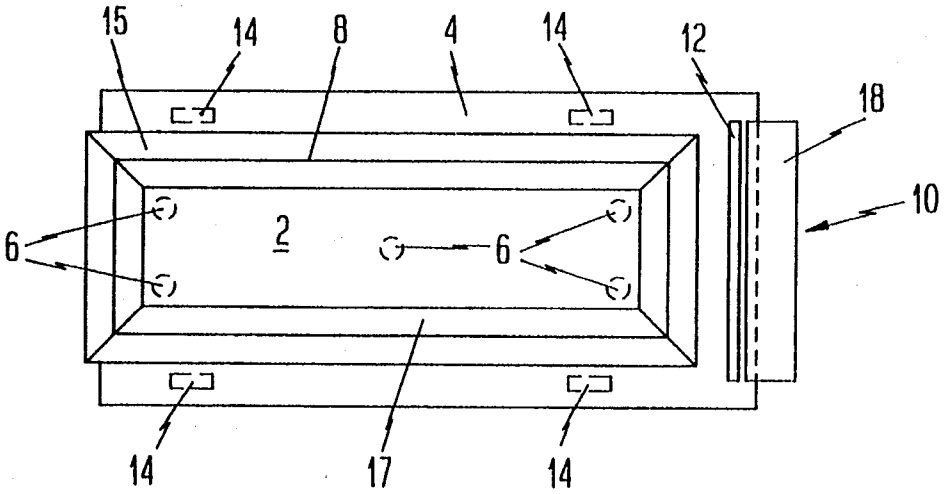
FIG. 2 is a top plan view of one movable carrier means as shown in FIG. 1.

FIG. 2 shows a top plan view of one of the carrier means 1 of FIG. 1. Here, especially the distribution in size of the vat 2 and its circumferential edge 15 can be seen in relation to the bulkhead wall 12 located at the face end 10 of the carrier means 1 and to the base plate 4. The width of the bulkhead wall 12 exceeds that of the vat 2 in order to warrant the shielding explained above both against sparks and against the thermal radiation of the preceding carrier means. The width of the bulkhead wall 12, however, is smaller than that of the base plate 4, as will be explained below with reference to FIG. 3. Finally, based on FIG. 2, the symmetric distribution can be recognized of the spacers or supports 6 which imparts to the vat 2 good configurational stability in spite of the high thermal stressing.

Figure 3:
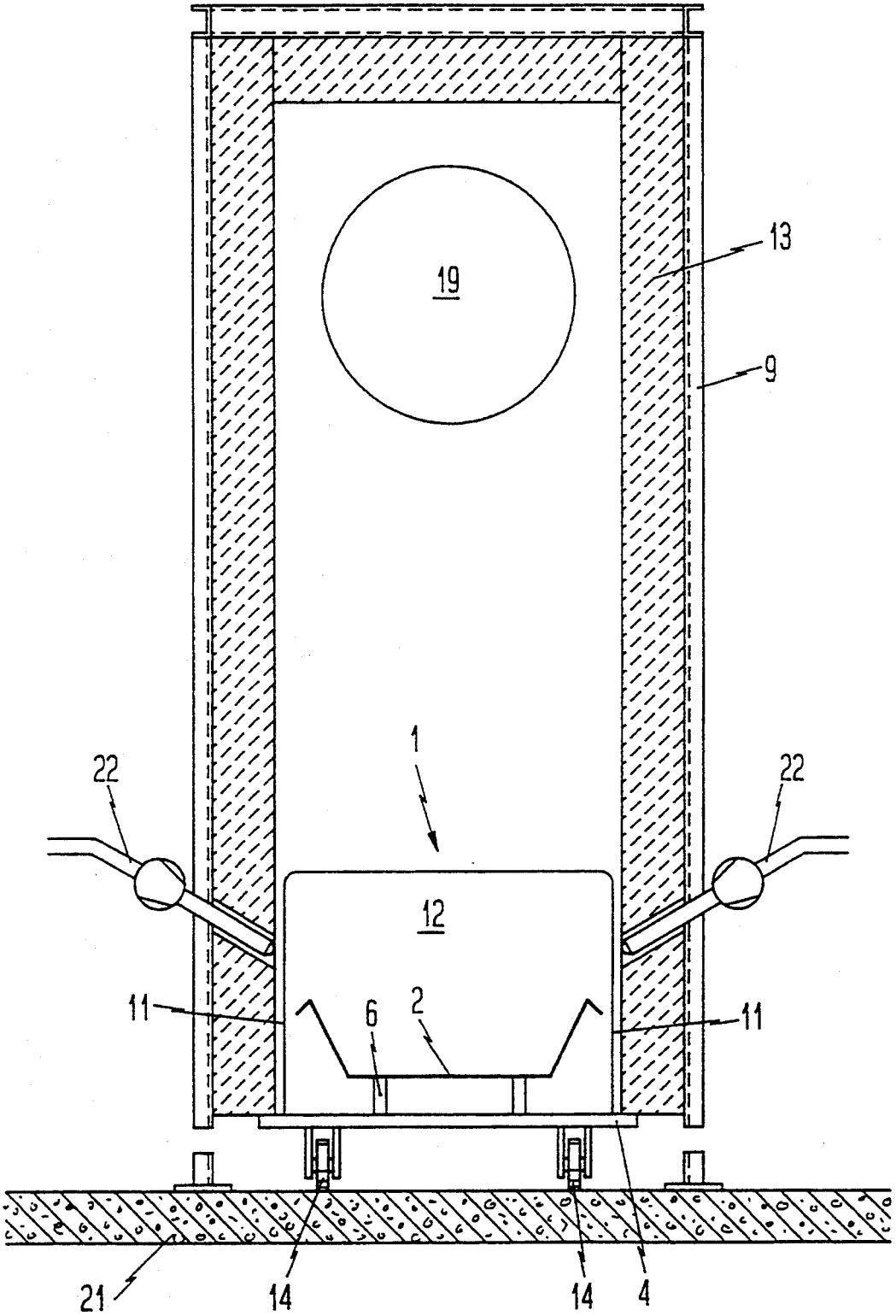
FIG. 3 is a cross sectional view of the deflagration zone of a deflagration reactor through which passes a movable carrier means according to FIGS. 1 and 2 at the level of the ignition device.

FIG. 3 shows a cross section through a deflagration reactor 9 whose inner walls are lined with temperature-proof fibrous material 13, for example rock wool. In the upper part of the deflagration reactor 9 a suck-off connection 19 is illustrated which is arranged in the exit zone 5 above the outlet passage 5' of the deflagration reactor 9 (FIG. 4).

Inside the deflagration reactor 9 at the level of the ignition device (bilateral burners 22) there is a movable carrier means according to FIGS. 1 and 2 whose bulkhead wall 12 with its side edges 11 closely glide along the inner lining 13 of fibrous material in the deflagration reactor 9 and, during the movement of the carrier means 1 through the deflagration reactor, scrape off solid reaction products which have deposited on the inner walls. The carrier means 1 with its wheels 14 rolls along a pathway 25 which is sunk in the concrete floor 21 of the deflagration reactor 9. A brush of conductive material (not shown) fixed to the carrier means 1 glides in pressurized fashion on each travelling track of a wheel 14, the brush being connected conductively to the carrier means 1 and thus counteracting any electrostatic charging of the carrier means 1 or of the wheels, respectively. To enhance this safety measure, the travelling tracks of the pathway 25, for instance, comprise a brass coat and the wheels 14 of the carrier means 1 are made of plastics.

Upon movement through the deflagration reactor 9 the base plate 4 extends laterally under the fibrous material lining 13, whereby the solid reaction products scraped off from the lining 13 by the bulkhead wall 12 are caught by the base plate 4 and conveyed out of the deflagration reactor 9.

Figure 4:
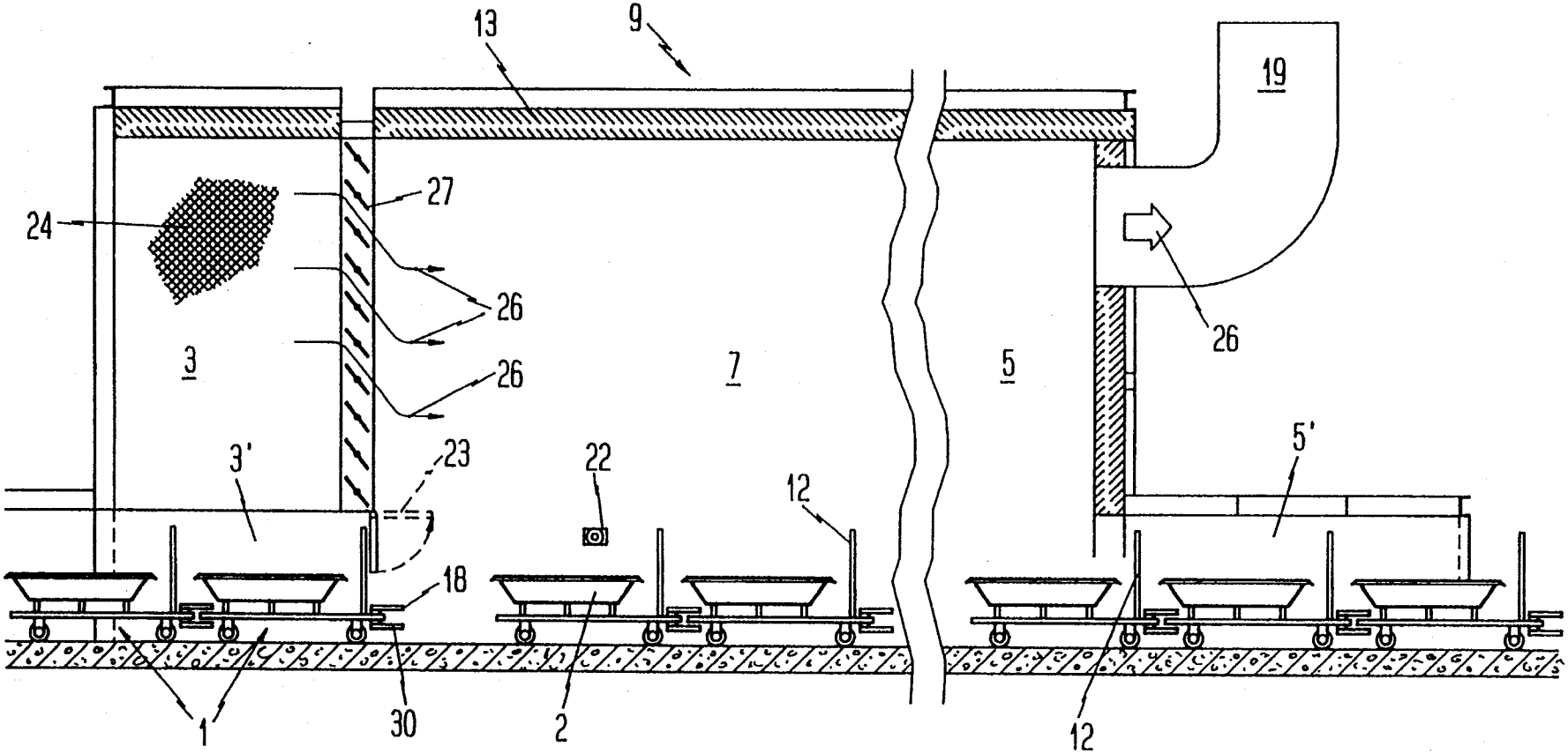
FIG. 4 is a longitudinal sectional view of a deflagration reactor according to FIG. 3 which is passed by a plurality of carrier means in the manner of assembly-line operation.

FIG. 4 shows the deflagration reactor 9 in longitudinal section. It can be seen here how a plurality of carrier means 1 coupled one behind the other through a conveyor means (not shown) successively pass first through an inlet passage 3' through the entry zone 3, then are moved on into the deflagration zone 7 to the burners 22, and subsequently leave the deflagration reactor 9 again through the outlet passage 5'. A spark flap 23 intended to prevent spark-over from the deflagration zone 7 to the carrier means already loaded with explosives in the inlet passage 3' is arranged at the transition from the entry zone 3 to the deflagration zone 7.

A continuous flow of air generated by an air suction means through one or more suck-in connections 24 and a suck-off connection 19 flows through the deflagration reactor 9 in the direction of arrow 26. This flow of air can be influenced by a shutter 27 which is adjustable and lockable as regards the louver position.

Figure 5:
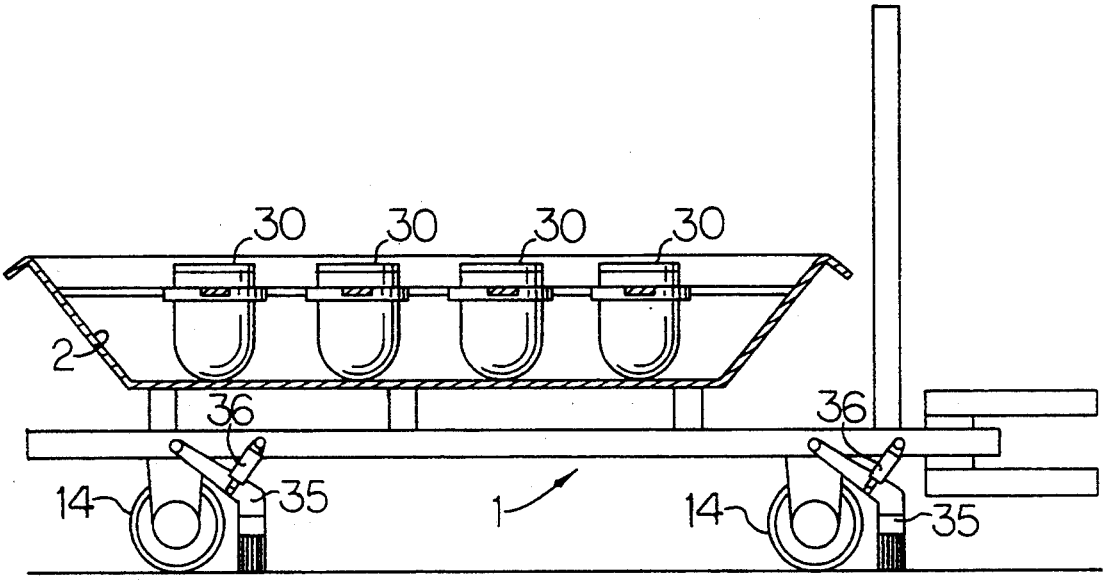
FIG. 5 is a side elevational view of a carrier means having devices for the reception or retention of bodies which contain explosives to be deflagrated.
Figure 6:
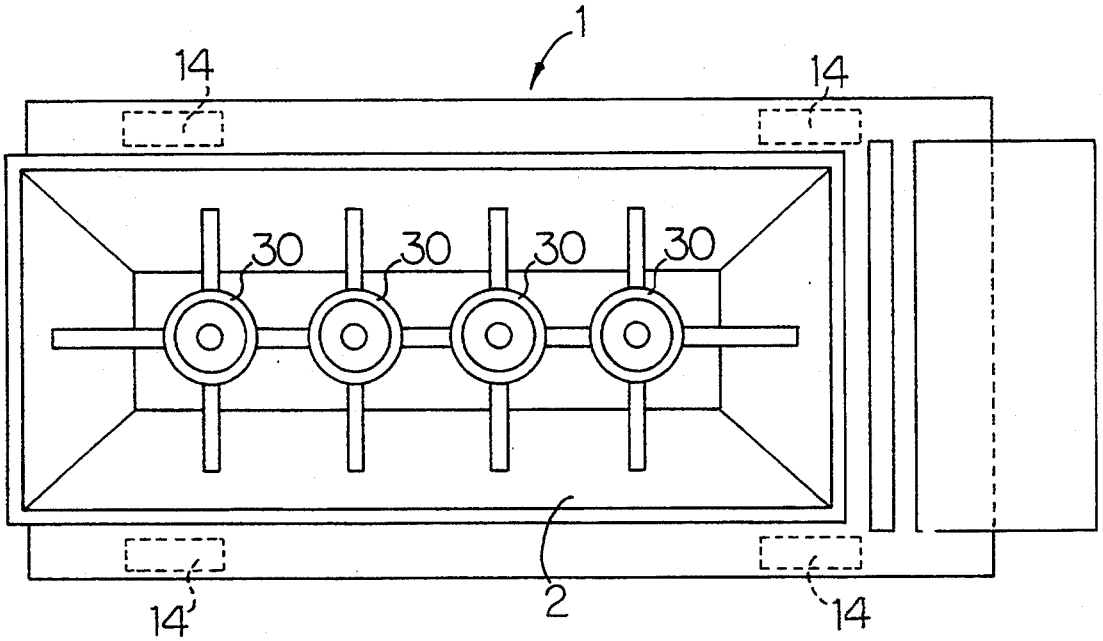
FIG. 6 is a top plan view of the movable carrier as shown in FIG. 5.

FIG. 5 shows one of the carrier means 1 which includes devices 30 carried within the vat 2 and provided for the reception or retention of bodies which contain explosives to be burned up or deflagrated. There is further provided a brush 35 of conductive material arranged in the travelling direction in front of each wheel 14 of the carrier means 1. Each brush is pressurized by devices 36 and is connected conductively to the carrier means 1 to glide on the track in front of each wheel and to serve to increase the operational safety of the carrier means 1.

I claim:

1. A carrier means as part of a conveyor means in an installation for the deflagration of explosives, comprising a base plate and a vat of scale- and temperature-proof material mounted on a base plate to take up the explosives, the installation for deflagration comprising a deflagration reactor through which the carrier means pass one after the other in assembly-line operation through an entry zone and an exit zone, characterized in that the vat is mounted spaced from the base plate by pillar-like supports which are distributed symmetrically on the area of the vat bottom; and in that a vertically upright bulkhead wall is arranged at at least one face end of the base plate, the width and height dimensions of the bulkhead wall being dimensioned such that they close the entry zone and the exit zone in substantially air-tight manner towards the outside.

2. The carrier means as claimed in claim 1, characterized in that the support are arranged in a symmetric pattern of five.

3. The carrier means as claimed in claim 1, characterized in that the vat is designed at its upper edge so as to circumferentially angularly jut out.

4. The carrier means as claimed in claim 1, the inner walls of the deflagration reactor being lined with a temperature-proof fibrous material, characterized in that the width of the bulkhead walls is selected such that the side edges of the bulkhead walls slide along the fibrous material.

5. The carrier means as claimed in claim 1, characterized in that the width of the bulkhead wall falls short of the width of the base plate by a defined amount, and in that the base plate extends laterally under the fibrous material lining.

6. The carrier means as claimed in claim 1, characterized in that the base plate is designed as an undercarriage with wheels, and in that an upper coupling plate and a lower coupling plate are fastened at one face end of the base plate, both coupling plates having the width of the bulkhead wall and projecting in longitudinal direction over the base plate to such an extent that they receive between them, at least in its marginal area, the base plate of an adjacent carrier means which is coupled on.

7. The carrier means as claimed in claim 1, characterized in that devices are provided for the reception or retention of bodies which contain explosives to be deflagrated.

8. The carrier means as claimed in claim 1, characterized in that a brush of conductive material is arranged in traveling direction in front of each wheel of the carrier means which brush is pressurized to glide on the track in front of the wheel and is connected conductively to the carrier means.

* * * * *

UNITED STATES PATENT AND TRADEMARK OFFICE

CERTIFICATE OF CORRECTION

PATENT NO. : 5,423,271

DATED : June 13, 1995

INVENTOR(S) : Wlater Schulze

It is certified that error appears in the above-indentified patent and that said Letters Patent is hereby corrected as shown below:

Column 4, line 28, after the word "reactor" delete everything through line 60 (pick up and continue with the word "whose").

Signed and Sealed this

Seventh Day of November, 1995

Bruce Lehman

*Attest:*

BRUCE LEHMAN

*Attesting Officer*

*Commissioner of Patents and Trademarks*